United States Patent [19]

Komarov et al.

[11] 4,031,927

[45] June 28, 1977

[54] HEALD FRAME DRIVE OF THE SHEDDING MOTION OF WAVE-TYPE SHEDDING LOOMS

[76] Inventors: Jury Ivanovich Komarov, ulitsa Miklukho-Maklaya, 29, korpus 1, kv. 215; Alexei Nikolaevich Parshin, Nagornaya ulitsa, 34, korpus 1, kv. 53; Ljubov Yakovlevna Gorbunova, Chertanovskaya ulitsa, 51, korpus 1, kv. 21, all of Moscow, U.S.S.R.

[22] Filed: Oct. 7, 1976

[21] Appl. No.: 730,462

[52] U.S. Cl. ..... 139/436; 139/92

[51] Int. Cl.[2] ..... D03D 47/26

[58] Field of Search ..... 139/13 R, 16, 79, 436

[56] References Cited

UNITED STATES PATENTS

| | | | |
|---|---|---|---|
| 2,144,947 | 1/1939 | Valentine | 139/436 |
| 2,724,413 | 11/1955 | Casati et al. | 139/16 |
| 3,749,135 | 7/1973 | Linka | 139/16 |

FOREIGN PATENTS OR APPLICATIONS

| | | | |
|---|---|---|---|
| 2,120,583 | 11/1971 | Germany | 139/436 |

*Primary Examiner*—Henry S. Jaudon
*Attorney, Agent, or Firm*—Steinberg & Blake

[57] ABSTRACT

The drive includes actuators having respective heald frames secured to the upper ends thereof, the lower ends having mounted thereon followers permanently engaging moving cam plates controlling the reciprocation of the heald frames. A longitudinal groove is made in each one of the actuators, receiving therein a spring having its axis offset with respect to the vertical axis of a respective follower, in the direction of movement of the cam plates. The proposed structure of the drive reduces its dimensions and enhances the reliability of its performance.

1 Claim, 3 Drawing Figures

HEALD FRAME DRIVE OF THE SHEDDING MOTION OF WAVE-TYPE SHEDDING LOOMS

The present invention relates to wave-type shedding looms and, more particularly, it relates to the heald frame drives of shedding motions in these looms.

The invention can most advantageously be used in wave-type shedding looms adapted to weave fabrics with more intricate patterns then plain weaves, i.e. in looms where a considerable number of heald frames or harnesses are arranged along the depth of the loom.

At present, there are known shedding motions wherein the drive of the heald frames includes a plurality of spring-urged actuators mounted for vertical reciprocation in their respective guides, the upper ends of these actuators having respective heald frames secured thereto, the frames carrying healds adapted to have the threads of the warp drawn there-through, the lower ends of the actuators carrying followers urged by the springs of the actuators into permanent engagement with cam plates moving in a horizontal plane.

In these known drives, the springs are received about the actuators, their axes being aligned with the vertical axes of the actuators themselves and of the followers.

However, with the springs received about the actuators, the height of the actuators and of their guides increases, which, in turn, results in an increased threading height which cannot be increased above a specified level defined by the production conditions (this limitation being imposed by the height of the loom operators). Furthermore, with the springs arranged in the above-described manner, there are developed considerable sidewise loads caused by the interaction of the followers with the system of the cam plates, which brings about an increased wear of the actuator-guide couples.

It is an object of the present invention to eliminate these disadvantages.

The present invention has for its aim the creation of a heald frame drive of the shedding motion for wave-type shedding looms, wherein the actuators should be of a structure providing for decreasing the height of the drive and to enhance the reliability of its performance.

This object is attained in a drive of the shedding motion for the heald frames of wave-type shedding looms, comprising a plurality of spring-urged actuators reciprocable in a vertical plane in respective guides, the upper ends of the actuators having secured thereto respective heald frames with healds adapted to have warp threads, drawn there-through, the lower ends of the actuators carrying followers permanently urged by respective springs of the actuators into engagement with cam plates moving in a horizontal plane, in which drive in accordance with the invention, each actuator has cut therein, over a portion equalling the length of a respective spring in the compressed state thereof, a longitudinal groove adapted to accommodate this spring, so that the axis of the spring is offset with respect to the vertical axis of the follower of a respective actuator in the direction of movement of the cam plates.

To ensure proper operation of the shedding motion, the springs of the actuators have to meet certain requirements concerning their length and rigidity. With these springs being accommodated within the bodies of the actuators, it becomes possible to curtail the overall height of the shedding motion, while retaining the necessary rigidity and length of the springs.

Furthermore, with the springs being offset with respect to the axes of respective followers, the value of the torque representing the action of the cam plates upon the followers is reduced. This is due to the fact that the torque produced by the spring and applied to the follower acts in opposition to the above-mentioned torque.

For the present invention to be better understood, given hereinbelow is a description of an embodiment thereof, with reference being had to the appended drawings, wherein.

Figure 1:
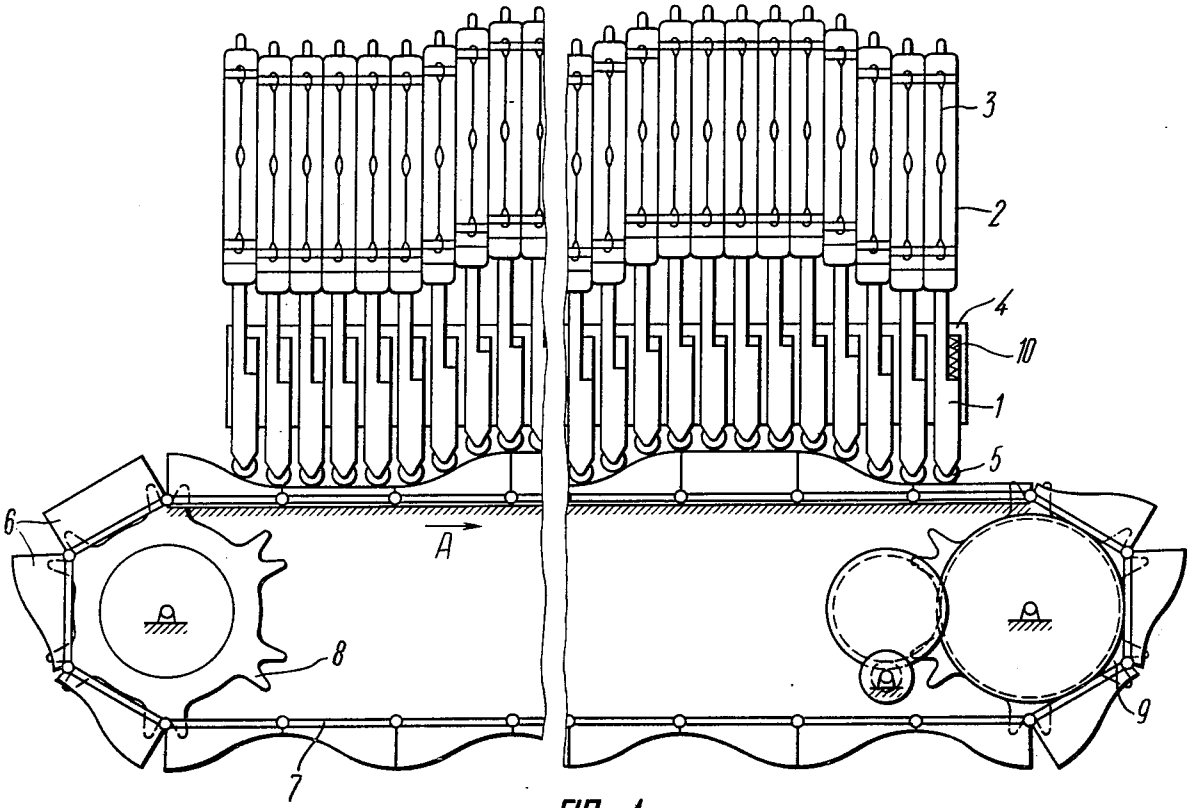
FIG. 1 is a general view of a shedding motion embodying the invention.
Figure 2:
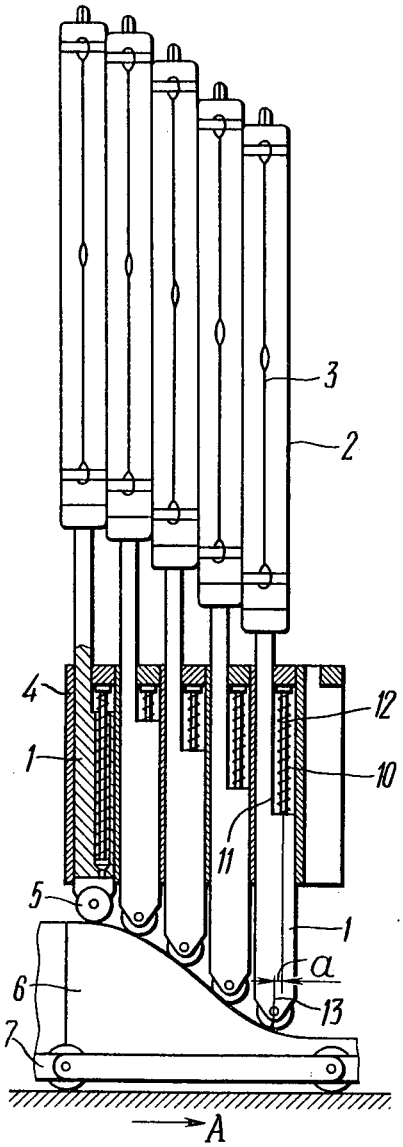
FIG. 2 is partly sectional front view of the actuators and guides of the shedding motion.
Figure 3:
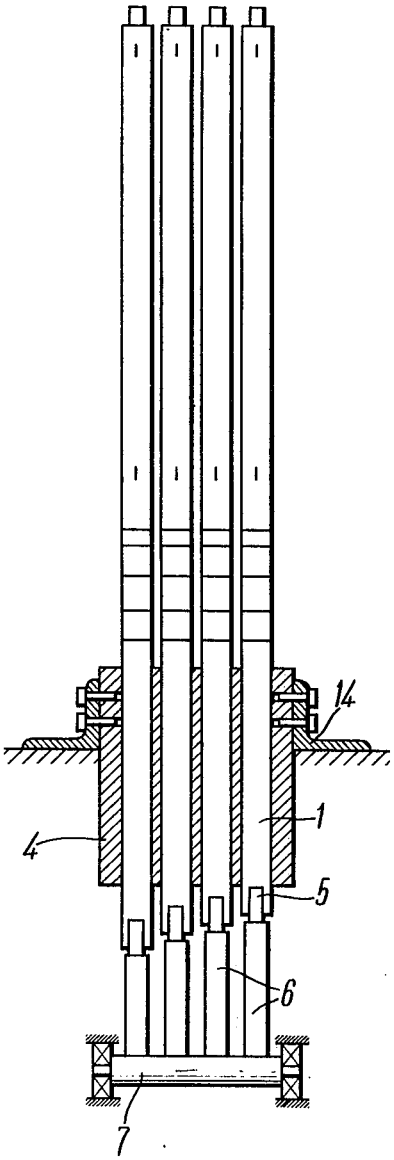
FIG. 3 is a side view of FIG. 2.

Referring now to the drawings, the shedding motion includes actuators or jack sticks 1 (FIG. 1) having secured to their top ends heald frames 2 with healds 3 through which warp threads can be drawn. The actuators 1 are mounted in guides 4 for reciprocation in a vertical plane. The bottom ends of the actuators carry respective followers 5 urged into permanent engagement with cam plates 6. These cam plates 6 are supported by an endless chain 7 which can be driven about sprockets 8 and 9. The permanent engagement of the followers 5 with the cam plates 6 is provided for by the action of springs 10 received in the longitudinal grooves 11 (FIG. 2) in the bodies of the actuators 1. Each groove 11 is made in the body of its respective actuator 1 over a length equalling that of the spring 10 in its compressed state. The axis 12 of each spring 10 is offset with respect to the vertical axis 13 of a respective follower 5 by a distance *a* in the direction of movement of the cam plates 6. This direction of movement of the chain 7 carrying the cam plates 6 is indicated in the drawing by arrow A. This relative offset of the axes 12 and 13 reduces the value of the side load brought about by the interaction of the followers 5 with the cam plates 6. The guides 4 (FIG. 3) are fixedly secured in brackets 14.

The herein disclosed shedding motion operates, as follows.

As the endless chain 7 is set into motion in the direction of the arrow A, the cam plates 6 act upon the followers 5 and thus make the actuators 1 move upward jointly with respective heald frames 2 with the healds 3.

With the actuators moving downward, following the contour of the cam plates 6, the permanent engagement between the followers 5 of the actuators 1 with the cam plates 6 is provided for by the action of the springs 10 of which the axes 12 are offset with respect to the vertical axes 13 of the respective followers 5.

Owing to this arrangement of the springs, the load applied by the cam plates to the followers of the actuators when the latter are being lifted, which load is further applied to the guides 4, is reduced, which reduces the friction between the actuators and their guides, and this fact enhances the reliability of the performance of the mechanism. Furthermore, the use of the herein disclosed shedding motion enables its overall height to be reduced.

What is claimed is:

1. A heald frame drive of the shedding motion of a wave-type shedding loom, comprising: guides; actuators accommodated in said guides for reciprocation in a vertical plane; heald frames secured to the top ends of respective actuators and having healds through which warp threads can be drawn; follower means carried by the bottom ends of said actuators; each said actuator having a longitudinal groove made therein; a spring accommodated in this groove; a plurality of cam plates adapted to move in a horizontal plane and be permanently engaged by said followers of respective actuators under the action of respective springs, to effect the reciprocation of said actuators jointly with said heald frames carried thereby, whereby sheds are formed of the warp threads; means for effecting the motion of said cam plates; each said spring being received in the longitudinal groove of a respective actuator so that the axis thereof is offset with respect to the vertical axis of a respective follower in the direction of movement of said cam plates.

* * * * *